United States Patent [19]

Arai et al.

[11] Patent Number: 4,875,335

[45] Date of Patent: Oct. 24, 1989

[54] APPARATUS AND METHOD FOR TREATING AN EXHAUST GAS FROM A DIESEL ENGINE

[75] Inventors: Yoshimasa Arai, Chiba; Satoshi Enamito, Tokyo; Noriyuki Oda, Chiba, all of Japan

[73] Assignee: Asahi Glass Company, Ltd., Tokyo, Japan

[21] Appl. No.: 247,929

[22] Filed: Sep. 23, 1988

[30] Foreign Application Priority Data

Sep. 25, 1987 [JP] Japan ..... 62-238913

[51] Int. Cl.[4] ..... F01N 3/02

[52] U.S. Cl. ..... 60/274; 55/272; 55/466; 55/DIG. 30; 60/295; 60/311

[58] Field of Search ..... 60/274, 279, 311, 295; 55/272, 283, DIG. 30, 466

[56] References Cited

U.S. PATENT DOCUMENTS

| | | | |
|---|---|---|---|
| 4,406,119 | 9/1983 | Kamiya | 55/466 |
| 4,433,986 | 2/1984 | Borst | 55/272 |
| 4,462,812 | 7/1984 | Bly | 55/DIG. 30 |

FOREIGN PATENT DOCUMENTS

| | | | |
|---|---|---|---|
| 213725 | 3/1987 | European Pat. Off. | 60/279 |
| 230140 | 7/1987 | European Pat. Off. | 60/279 |
| 129020 | 10/1981 | Japan . | |
| 268813 | 11/1986 | Japan . | |
| 96719 | 5/1987 | Japan . | |

*Primary Examiner*—Douglas Hart

*Attorney, Agent, or Firm*—Oblon, Spivak, McClelland, Maier & Neustadt

[57] ABSTRACT

In an apparatus for treating an exhaust gas from a diesel engine, including a filter unit in an exhaust gas passage for the diesel engine, the filter unit having a honeycomb structure wherein a plurality of cells are divided by cell walls having a filtration function and extend in the same direction as one another, predetermined cells being closed at one end, and the remaining cells being closed at the other end; the improvement comprises: back washing gas flow generating means for generating a gas flow at appropriate intervals so as to pass through the cell walls in the direction opposite to the flow of the exhaust gas flow, and a recollecting unit for particulates, which is provided in the exhaust gas passage at a position upstream to the filter unit.

20 Claims, 5 Drawing Sheets

APPARATUS AND METHOD FOR TREATING AN EXHAUST GAS FROM A DIESEL ENGINE

The present invention relates to an apparatus and a method for treating an exhaust gas from a diesel engine which is used in various vehicles such as passenger cars, trucks, buses, railway cars and so on, and further industrial machines, ships and so on. More particularly, the present invention relates to an apparatus and a method for using a filter unit to give treatment, such as trapping and removing, to particulates containing carbon as a main component in the exhaust gas.

The exhaust gas discharged from the diesel engine contains a fairly large quantity of particulates including carbon particles as a main component, which would cause air pollution. Various method for trapping or removing such particulates in the exhaust gas from the diesel engines by using a filter unit have been proposed.

For example, Japanese Unexamined Patent Publication No. 124417/1981 and Japanese Unexamined Patent Publication No. 129020/1981 disclose a method wherein a filter unit 10 made of ceramics as shown in FIGS. 4 and 5 is used to trap and remove the particulates in the exhaust gas.

The filter unit 10 has a basic construction wherein the inside is divided by porous ceramic cell walls 11 having filtration function (a gas can pass through, but most solid particulates, in particular substantially all the solid particulates can be prevented from passing through) to form a honeycomb structure having a plurality of cells 12 and 13 which are adjacent to each other through the cell walls 11 as boundaries. The cells 12 and 13 extend in parallel in the longitudinal direction.

The cells 13 have the end at the side of one end face 16 of the filter unit 10 closed with sealing members 14 and have the end at the side of the other end face 17 opened. The cells 12 have the end at the side of the one end face 16 of the filter unit 10 opened and have the end at the side of the other end faces 17 closed with sealing members 15. As can see from slant hatched lines indicating the closed end of each cell in FIG. 4, the cells 12 and 13 are alternately arranged so as to form a check pattern.

When the exhaust gas from the diesel engine is fed through the one end face 16 of the filter unit 10, the exhaust gas passes from the cells 12 to the cells 13 through the cell walls 11 and is discharged from the other end face 17. While the particulates in the exhaust gas cannot pass through the cell walls 11, and they adhere on the surfaces of the cell walls 11 at the side of the cells 12 to deposit thereon, a clean exhaust gas with such particulates removed flows out of the cells 13.

The continuation of such filtration operation causes filtration resistance to increase due to the accumulation of the particulates on or the clogging of the particulates in the cell walls 11, which makes further filtration operation difficult. In order to avoid such situation the accumulated particulates which consist mainly of carbon particles are burned off at suitable time intervals to be removed from the surfaces of the cell walls, thereby refreshing the filtration function of the filter unit 10. For example, electric heaters are arranged adjacent to the end faces 16 and 17 of the filter unit, the heaters are energized to set fire to the particulates is accumulated near to the heaters. The burning of the particulate layer which has started at a position near to the end faces 16 and 17 spreads to the central portion of the filter unit.

Finally, the particulates on the entire surfaces of the filter unit 10 are burned to be removed therefrom.

By the way, in such conventional technique, the burning of the particulates usually causes the filter unit 10 to be heated to 600°-1,000° C., or it sometimes causes the filter unit to be heated to a high temperature more than 1,000° C. This is the reason why the filter unit 10 must be made of ceramics so as to withstand such high temperatures.

In addition, in burning the particulates to be removed, the filter unit is repeatedly heated to such high temperature to be further sintered. As a result, the pore size and the pore distribution in the original filter unit are changed, and trapping efficiency and pressure loss change with the lapse of time, thereby making the maintainance of a stable filtration function difficult. In most cases, deterioration with aging in the filtration function is created. In particular, there has often arisen the case wherein the cell walls 11 are melted under a high temperature given at the time of burning the particulates for removal so as to be substantially unable to trap the particulates.

Furthermore, the exhaust gas from the diesel engine contains not only carbon particles but also an unnegligible amount of non-combustible solid particles (for instance, 1-5% by weight to the total amount of the particulates), and these non-combustible solid particles are also trapped by the filter unit. And, SOx or NOx in the exhaust gas reacts with materials constituting the passages for the exhaust gas or the filter unit to produce non-combustible solid components, which are deposited on the cell walls of the filter unit. These non-combustible solid components accumulate without being removed by burning, to deteriorate the properties of the filter unit.

Japanese Unexamined Patent Publication No. 268813/1986 discloses a method wherein the carbon particles trapped by such filter unit are released from the filter unit by a pulsed flow of air flowed intermittently in the direction opposite to the flow of the exhaust gas, and the released particulates are carried on the flow of the intake gas for the diesel engine to be directed into the intake port of the engine where the particulates are burned.

This method has a disadvantage in that the intake gas including the solid particulates is supplied to the engine that is to be suck air purified by the air cleaner, so as to accelerate the wear of the engine parts. In addition, not only the carbon particles but also the non-combustible solid components are fed into the engine, and the non-combustible solid components are accumulated in the engine system without being removed by burning, so as to create several kinds of problems, which could damage the engine and shorten the life time of the engine. Furthermore, there is another problems wherein it is necessary to provide a long by-pass tube which connects between the filter unit and the normal intake gas passage.

It is an object of the present invention to eliminate the above-mentioned disadvantages of the conventional apparatus and method.

It is another object of the present invention to provide an apparatus and a method wherein a filter unit allowing a wide range of the selection of material is used to trap or remove particulates in an exhaust gas from a diesel engine.

It is still another object of the present invention to provide an apparatus or method for trapping or removing particulates accumulated in a filter unit without heating the filter unit to a high temperature and without recycling the particulates into the engine.

It is still other object of the present invention to provide an apparatus or a method wherein not only combustible particulates but also non-combustible particulates can be trapped or removed.

It is a further object of the present invention to provide an apparatus and a method for trapping or removing particulates, which assures filtering properties in a stable manner for a long time.

Other objects of the present invention will become apparent from the following detail description.

According to the present invention, there is provided an apparatus for treating an exhaust gas from a diesel engine, including a filter unit in an exhaust gas passage for the diesel engine, the filter unit having a honeycomb structure wherein a plurality of cells are divided by cell walls having a filtration function and extend in the same direction as one another, predetermined cells being closed at one end, and the remaining cells being closed at the other end; the improvement comprising back washing gas flow generating means for generating a gas flow at appropriate intervals so as to pass through the cell walls in the direction opposite to the flow of the exhaust gas flow, and a recollecting unit for particulates, which is provided in the exhaust gas passage at a position upstream to the filter unit.

Further, according to the present invention, here is provided a method for treating an exhaust gas from a diesel engine, comprising; using a filter unit having a honeycomb structure wherein a plurality of cells are divided by cell walls having a filtration function and extend in the same direction as one another, predetermined cells being closed at one end, and the remaining cells being closed at the other end; and passing the exhaust gas from one surface to the other surface of the cell walls; the improvement comprising; forcing a back washing gas flow to pass through the cell walls in the direction opposite to the flow of the exhaust gas at appropriate intervals, and trapping particulates in the exhaust gas in a recollecting unit for the particulates, which is provided in an exhaust gas passage at a position upstream to the filter unit.

Furthermore, according to the present invention, there is provided a method for treating an exhaust gas from a diesel engine, which comprises; using a plurality of filter units having a honeycomb structure wherein a plurality of cells are divided by cell walls having a filtration function and extend in the same direction as one another, predetermined cells being closed at one end, and the remaining cells being closed at the other end; and passing the exhaust gas from one surface to the other surface of the cell walls; the improvement comprising:

forcing a back washing gas flow to pass through the cell walls in the direction opposite to the flow of the exhaust gas in at least one of the filter units at appropriate intervals;

keeping the exhaust gas to pass from one surface to the other surface of the cell walls in at least one of the remaining filter units during when the back washing gas flow is being forced to pass through the cell walls in the direction opposite to the flow of the exhaust gas in at least one of the filter units; and trapping particulates in the exhaust gas in a recollecting unit for the particulates, which is provided in an exhaust gas passage at a position upstream to the filter unit.

According to a preferred embodiment of the present invention, the recollecting unit is arranged adjacent to the filter unit, which allows the particulates to be recollected more effectively in comparison with the provision of the recollecting unit adjacent to the engine.

According to another preferred embodiment of the present invention, the recollecting unit is arranged below the filter unit, which allows the particulates to be effectively collected in the recollecting unit because most of the particulates, in particular most of the agglomerates of the particulates, drop by gravity.

According to still another preferred embodiment of the present invention, an exhaust gas passage at the recollecting unit is formed more greatly than the exhaust gas passage upstream to the recollecting unit in terms of its cross-sectional area, so that the flow velocity of the exhaust gas at the recollecting unit is smaller than the flow velocity of the exhaust gas in the exhaust gas passage upstream the recollecting unit. This allows the particulates collected in the recollecting unit to be prevented from being drifted in the exhaust gas by the flow of the exhaust gas, and the particulates to be effectively collected in the recollecting unit.

According to a further preferred embodiment of the present invention, the recollecting unit is provided with a filter plate.

According to a still further preferred embodiment of the present invention, the recollecting unit, in particular the filter plate, is provided with burning means for the particulates. The trapped particulates are burned in the recollecting unit, in particular on the filter plate, by the burning means. The burning means is preferably constituted by at least one of an electric resistance type heater, an oxidation catalyst and a fluid fuel feeding type combustion burner, and in particular the electric resistance type heater is most preferable.

According to a still further preferred embodiment of the present invention, a nozzle for ejecting a pressurized gas as the back washing gas flow generating means is provided in the exhaust gas passage at a position downstream to the filter unit.

According to a further preferred embodiment of the present invention, each time the exhaust gas from the diesel engine is continuously passed from one surface to the other surface of the cell walls in the filter unit for a time not shorter than 30 seconds and not longer than 30 minutes, a back washing gas flow is generated for a time not shorter than 0.01 sec and not longer than 5 sec to forcibly pass through the cell walls in the direction opposite to the flow of the exhaust gas.

According to a further preferred embodiment of the present invention, the difference between the gas-permeation pressure loss in the cell walls just after the back washing gas flow has passed, and the gas-permeation pressure loss in the cell walls just before the back washing gas flow starts passing is determined to be 250 $mmH_2O$ or below.

According to a further preferred embodiment of the present invention, when a plurality of filter units are utilized, the particulates collected from the filter units are trapped in a single recollecting unit, in particular, on a signal filter plate.

According to a further preferred embodiment of the present invention, when a plurality of filter units are utilized, the particulates collected from the filter units are trapped in a plurality of recollecting units arranged so as to correspond to the respective filter units, in particular, on a plurality of filter plates.

Figure 1:
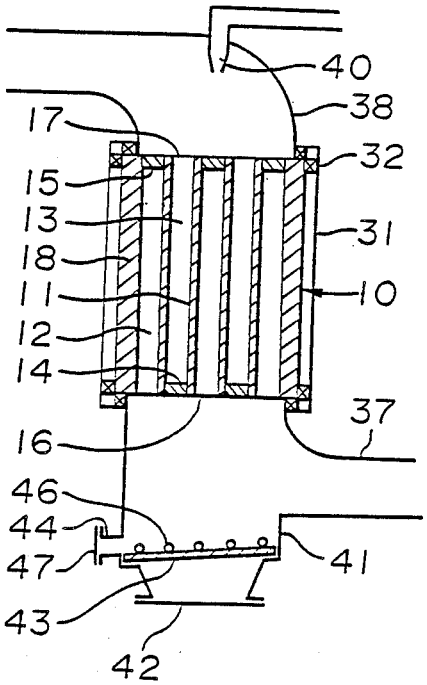
FIG. 1 is a vertical cross-sectional view showing a first embodiment of the present invention.

Now, the present invention will be described in detail in reference to the accompanying drawings, though the present invention is not limited to the embodiments as shown in the drawings.

In accordance with the present invention, the flowing direction of a gas which passes through the cell walls at a back washing operation is opposite to the flowing direction of the gas at a particulate collecting operation. In the following description, the terms "upstream" and "downstream" are used on the basis of the flowing direction of the gas at the particulate collecting operation unless a specific note is given.

FIG. 1 shows a first embodiment of the apparatus for treating an exhaust gas from a diesel engine according to the present invention.

Figure 4:
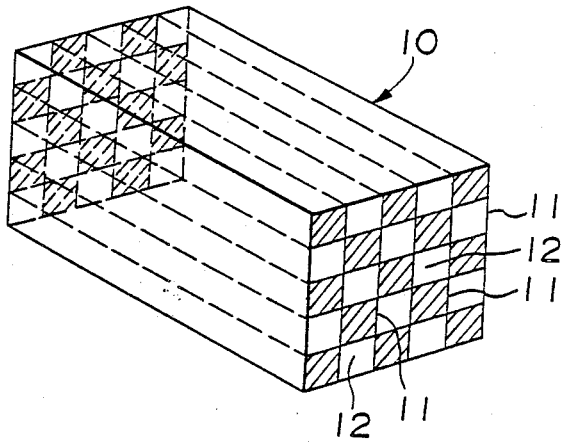
FIG. 4 is a diagram showing a filter unit utilized in the present invention.
Figure 5:
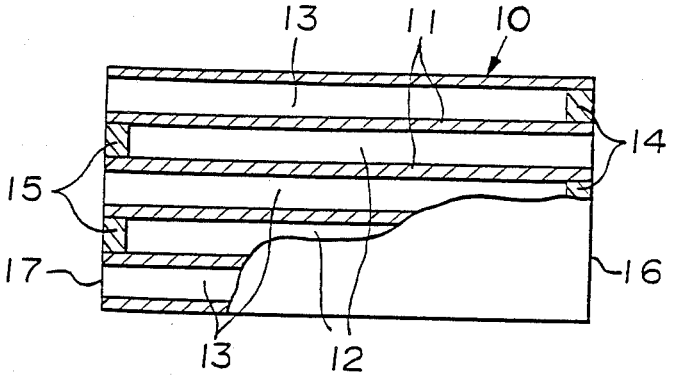
FIG. 5 is a vertical cross-sectional view showing the filter unit of FIG. 4, with a portion broken away to reveal the essential parts.

A filter unit 10 having a cylindrical form is installed in a casing 31 having openings at an upper and a lower part by interposing sealing members 32. The filter unit 10 is substantially the same as the filter unit as shown in FIGS. 4 and 5. The filter unit can adopt a square, a rectangular, a circular, an oval form or others as its cross-sectional shape, as required. Cells 12 and 13 extend in the vertical direction. Closing members 14 and 15 are positioned in the lower face and an upper face of the filter unit 10, respectively. Although a small number of cell walls 11 are shown in FIG. 1 for the sake of clarity, a great number of the cell walls having a thin thickness are in practice provided at quite short intervals. An outer wall 18 forming the periphery of the filter unit 10 is thicker than the cell walls 11 to prevent the filter unit 10 from being damaged. In addition, the outer wall can be formed to be gas-impermeable so as to prevent the particulates from being deposited on the inner surface of the outer wall.

Just below the casing 31, a recollecting unit 41 for the particulates is arranged. Between the casing 31 and the recollecting unit 41, an inlet conduit 37 for an exhaust gas from a diesel engine is opened, approaching from sideway.

As seen from FIG. 1, the recollecting unit 41 is placed in the vicinity of the filter unit 10. The filter unit 10 is placed so that the distance from the upstream end face 16 of the filter unit 10 to the recollecting unit 41 is 50 cm or below, more preferably 30 cm or below. As also seen from FIG. 1, the exhaust gas passage around the recollecting unit 41 is enlarged in comparison with the inlet conduit 37 so as to make the flow velocity of the exhaust gas flowing around the recollecting unit 41 smaller than the flow velocity of the exhaust gas flowing through the inlet conduit 37.

The recollecting unit 41 is formed so as to have a hollow cylindrical shape, and have a bottom portion provided with a cover plate 42 so as to open and close it. The recollecting unit has a filter plate 43 with an electric resistance type heater 46 on it placed so as to gradually slant at a position near and above the cover plate 42. The recollecting unit is also provided with an ash component removing port 44 with a lid 47 which can be opened but is normally closed. The ash component removing port 44 is opened just above and laterally from the filter plate 43.

The casing 31 has the upper portion connected to an exhaust gas outlet conduit 38. At a position which is directly above the casing 31, the outlet conduit 38 includes a nozzle 40 for ejecting a pressurized gas with the opening of the nozzle being directed towards the outlet end face 17 of the filter unit 10.

The cell walls 11 of the filter unit 10 can be made of sintered metal or inorganic fiber, and is preferably made of ceramics. The cell walls could be made of an organic fiber shaped product of which filter paper and filter cloth are representative, or a shaped-product which is formed by mixing the organic fiber with suitable inorganic powder, a binder or others, depending on the temperature of the exhaust gas.

The filter plate 43 is made of a material having fliterability. Although the filter plate 43 could be made of sintered metal, it is preferably made of ceramics or inorganic fiber because it is repeatedly heated. When the filter plate is made of ceramics, it is preferable to use a ceramic material having thermal expansion coefficient of $5\times10^{-6}/°$ C. or below, such as mullite, chamotte, cordierite and so on. The filtration area of the filter plate 43 does not have to be great, and it is preferable to be small in general.

The operation of the apparatus according to the first embodiment will be described. The exhaust gas from the diesel engine is flowed towards the upstream end face 16 of the filter unit 10 through the inlet conduit 37, with the cover plate 42 and the lid 47 of the recollecting unit closed. The exhaust gas that has come into the cells 12 passes through the cell walls 11 where the particulates in the exhaust gas are mostly or almost entirely separated, and the exhaust gas almost free from the particulates flows to the outlet conduit 38 through the cells 13. The particulates, which mainly comprises carbon, adhere and deposit on the surfaces at the side of the cells 12 of the cell walls 11. Some parts of the particulates agglomerated by adhering and depositing drop onto the filter plate 43 by their weight in some instances.

After the continuation of the particulate collecting operation as mentioned above for an appropriate time, a short time back washing operation is carried out. In the back washing operation, a pressurized gas, especially pressurized air, is ejected form the nozzle 40 for a short time such as about 0.1–1 sec. The ejected gas induces a gas around the nozzle 40 to produce a pulse flow of gas the amount of which extremely exceeds the original amount of the ejected gas. The pulse flow of gas enters from the end face 17 into the cells 13 of the filter unit 10, passes through the cell walls 11 and runs into the cells 12. At that time, the particulates accumulated on the cell walls 11 are peeled off. Although a part of the particulates flows into the inlet conduit 37, most of the particulates drop into the recollecting unit 41 to deposit on the filter plate 43 because most of the particulates are agglomerated. The particulates which have flowed into the inlet conduit 37 are recollected in the filter unit 10 again under the particulate collecting operation after the back washing operation. Thus, substantially all the particulates deposit on the filter plate 43 while the particulate collecting operation and the back washing operation are repeatedly carried out.

At the back washing operation, it is effective to keep the cover plate 42 opened. This allows significant parts of the gas flow to pass through the filter plate 43, thereby causing most of the peeled particulates to be carried on the gas flow so as to be deposited on the filter plate 43.

Thus, the particulates trapped on the cell walls 11 during the particulate collecting operation are moved onto the filter plate 43 by carrying out the back washing operation, thereby refreshing the filtration function of the filter unit 10. The particulates on the filter plate 43 are heated by the heater 46 to be burned off.

The heating by the heater 46 can be continuously made throughout the particulates collecting operation and the back washing operation, or can be carried out only when the particulates more than a predetermined amount have deposited on the filter plate 43. In the latter case, the heating can be carried out only at the time of ignition, or can be continued during burning.

During a relatively long term use of the apparatus, there occurs the accumulation of non-combustible particulates and ash in the recollecting unit 41, especially on the filter plate 43. In this case, the lid 47 is opened to drop out the particulates and ash by gravity. Alternately, they may be forcibly removed by suitable scraping means.

Figure 2:
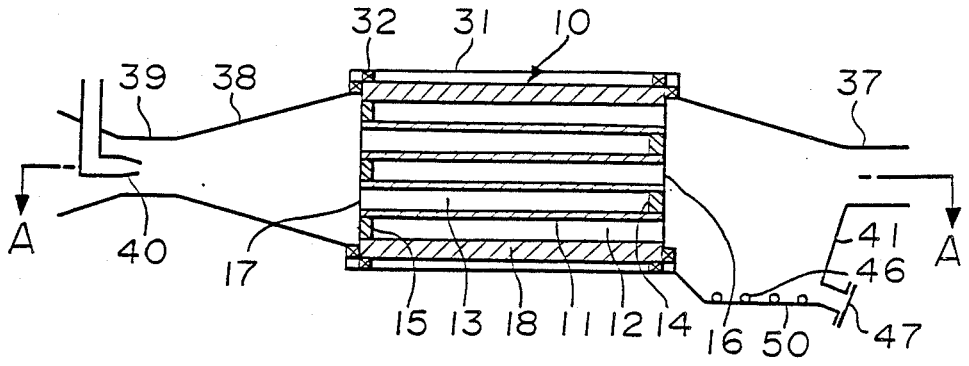
FIG. 2 is a vertical cross-sectional view showing a second embodiment of the present invention.

FIG. 2 shows a second embodiment of the present invention. In the second embodiment, the filter unit 10 is arranged so that the cells 12 and 13 extend in the horizontal direction. As required, the filter unit can be lifted at the side of the outlet conduit 38 to be slanted as a whole.

The outlet conduit 38 is provided with a throat portion 39 having a reduced diameter part, and the portions of the conduit continuous to the upstream and the downstream end of the throat portion are gradually expanded. The nozzle 40 is provided near to the downstream end of the throat portion 39. The recollecting unit 41 is arranged upstream to the filter unit 10 so that the recollecting unit 41 is positioned below and near to the filter unit 10. The recollecting unit 41 is not provided with the filter plate 43 and the cover plate 42. The recollecting unit 41 has the bottom surface constituted by a tray 50, which has a heater 46 on the inner surface. When the tray 50 or at least the inner surface of the tray is made of an insulating material such as ceramics, the ignition to and the burning of the particulates progresses rapidly.

In accordance with the second embodiment, the ejector effect is in full play around the throat portion 39 during the back washing operation to create a back washing gas flow, the amount of which is several times the original amount of the gas ejected from the nozzle 40. The created back washing gas flow comes into the cells 13. Most of the particulates are peeled off by the back washing gas flow, come out of the filter unit 10, and then drop to deposit on the tray 50. Also in the second embodiment, substantially all the particulates deposit on the tray 50 while the particulates collecting operation and the back washing operation are repeated. The particulates as deposited are heated with the heater 46 to be burned off.

Figure 3:
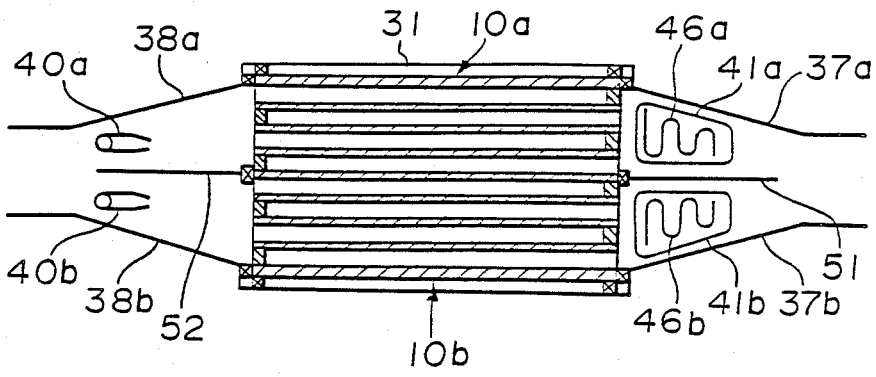
FIG. 3 is a transverse cross-sectional view showing a third embodiment of the present invention, the view being taken on the plane corresponding to line A—A in FIG. 2.

FIG. 3 shows a third embodiment of the present invention. In the third embodiment, the filter unit 10 is divided into two zones **10*a* and 10*b* along a longitudinal plane including the axis of the filter unit. The two zones are provided with inlet conduits 37*a* and 37*b*, recollecting units 41*a* and 41*b*, heaters 46*a* and 46*b*, outlet conduits 38*a* and 38*b*, and nozzles 40*a* and 40*b*, respectively. In the inlet conduit 37 and the outlet conduit 38, there are provided partition plates 51 and 52**, respectively. Other structure of the third embodiment is the same as the second embodiment.

In the third embodiment, the particulate collecting operation is carried out in the zones **10*a* and 10*b* of the filter unit 10 simultaneously. At the time of the back washing operation, the nozzle 40*a* and the nozzle 40*b* alternately eject a pressurized gas to alternately refresh the zones in the filter unit 10**.

In the first and second embodiments, it is necessary that the time required for the back washing operation is short because the flow of the exhaust gas from the engine is blocked while the back washing operation is being carried out. In addition, even if the time is short, the back pressure of the engine may increase, adversely affecting the performance of the engine. On the other hand, in the third embodiment, one of the zones in the filter unit 10 is under the particulates collecting operation while the other zone is under the back washing operation. As a result, the time required for the back washing operation can be prolonged in comparison with the second embodiment, and unfavorable effect to the performance of the engine can be substantially negligible. The prolonged back washing time provides such advantages that the gas pressure for the back washing operation can be reduced, a gas-flow producing system for back washing other than the ejector nozzle can be utilized, and the filter unit 10 can be effectively refreshed. Above-mentioned advantages are attainable when each of two or more filter units is installed in its corresponding casing.

Figure 6:
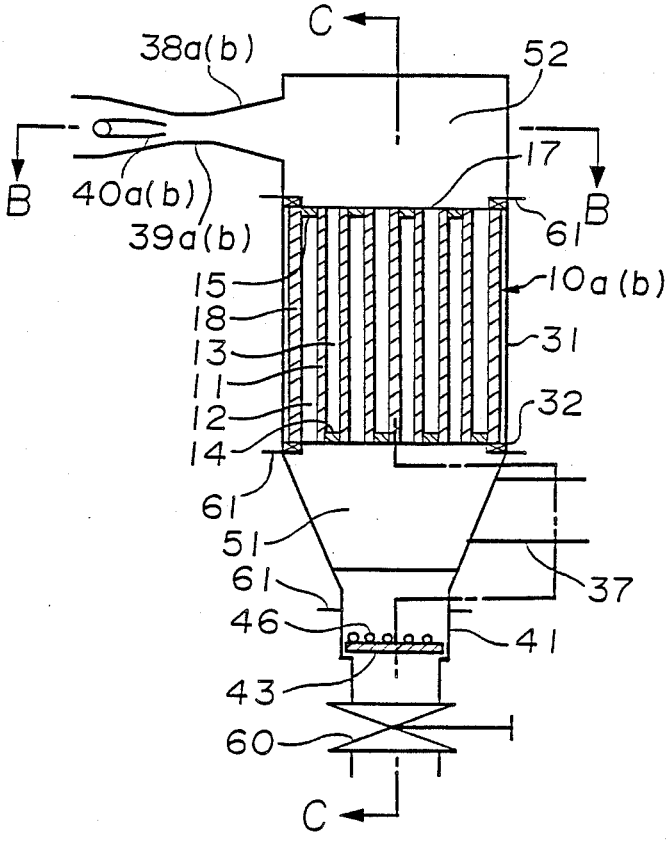
FIG. 6 is a vertical cross-sectional view showing a fourth embodiment of the present invention.
Figure 7:
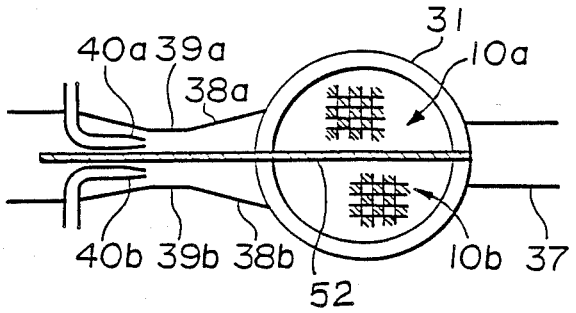
FIG. 7 is a cross-sectional view taken on line B—B in FIG. 6.
Figure 8:
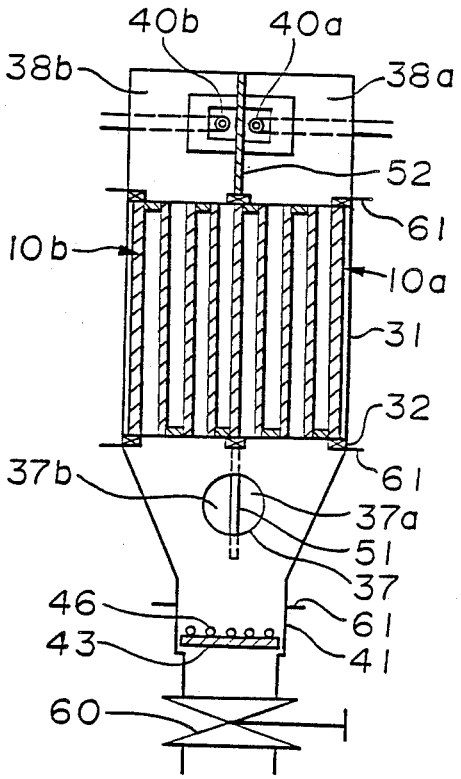
FIG. 8 is a vertical cross-sectional view taken on line C—C in FIG. 6.

FIGS. 6, 7 and 8 show a fourth embodiment of the present invention. In the fourth embodiment, the filter unit 10 is arranged so that the cells 12 and 13 extend in the vertical direction like the first embodiment. In addition, the filter unit is divided into the two zones **10*a* and 10*b*** so as to be utilized like the third embodiment. Similar or corresponding parts are indicated by the same reference numerals as the first through third embodiments, and the explanation on those parts is omitted for the sake of clarity.

In the fourth embodiment, the partition plates 52 and 51 are vertically placed so as to adjoin the upper end face 17 and the lower end face 16, respectively, of the filter unit 10 having a cylindrical form. The filter plate 43 has a circular form and is horizontally placed in the recollecting unit 41 at a position that is slightly lower than the lower end of the partition plate 51. Below the filter plate 43, there is provided a valve 60 in place of the cover plate 42 in the first embodiment. On the upper surface of the filter plate 43, a filament heater 46 is arranged in a meander shape or a spiral shape.

The exhaust gas from the inlet conduit 37 which is provided below and laterally of the filter unit is directed into the filter unit, being distributed into the inlet conduit **37*a* and the inlet conduit 37*b* by the partition plate 51. The partition plate 52 divides the portion of the exhaust gas passage downstream to the filter unit, which extends from the upper end face 17 of the filter unit to downstream of the nozzles 40a and 40b, as shown in FIG. 7. Reference numeral 61 designates a flange which is provided on the casing 31 or on the end of the recollecting unit 41 facing the filter unit. The valve 60 is opened and closed, being interlocked with the timing of ejecting the pressurized gas from the nozzles 40a and 40b**.

EXPERIMENTAL EXAMPLE

A diesel engine for a truck having an effective displacement of 6560 $cm^3$ and a maximum power of 195 HP was driven under 1,800 RPM and 126 HP. A suitable part of the exhaust gas from the engine was distributed to be introduced into the apparatus of the fourth embodiment.

The filter unit had an outer diameter of 144 mm, a height of 152 mm, a cell wall thickness of about 0.3 mm, a cell density of about 200 cells/$in^2$ and a filtration area of about 2.3 $m^2$, and was made of a cordierite material having an average pore size of about 15 $\mu$m, which was measured with a mercury porosimeter.

The filter plate 43 had an outer diameter of 120 mm and a thickness of 15 mm, and was made of a cordierite material having an average pore size of about 30 $\mu$m, which was measured with a mercury porosimeter.

The temperature of the exhaust gas introduced into the filter unit was about 440° C. The flow velocity of the exhaust gas at the time of passing through the cell walls 11 was about 4.5 cm/sec.

The zone 10a in the filter unit was repeatedly subjected to the cycle wherein after the particulate collecting operation was carried out for 5 minutes, a pressurized air was ejected by the corresponding nozzle 40a for 0.1 sec to perform the back washing operation. The zone 10b in the filter unit was repeatedly subjected to the same cycle as the zone 10a, keeping a time lag of 2.5 minutes in reference to the cycle of the zone 10a. The valve 60 was opened only for the time between about 2 sec before and about 8 sec after the pressurized air was ejected from the nozzle 40a and the nozzle 40b, and was closed for the other time.

Such repeated cycles were continued for 1 hour without energizing the heater 46. As a result, it was found that the exhaust gas directed from the inlet conduit 37 included the particulates of about 0.18 g/$Nm^3$ whereas the exhaust gas discharged out of the system through the outlet conduit 38 included the particulates of 0.003 g/$Nm^3$ or below. It was also found that the weight of the particulates accumulated on the filter plate 43 was about 95% or above of the total weight of the particulates included in the exhaust gas, which was directed from the inlet conduit 37 for that time.

In addition, when the heater 46 was energized to be heated to about 600° C., the particulates on the filter plate 43 started burning. Even if the heater 46 was deenergized or the energizing amount to the heater was cut by half after that, the burning of the particulates continued and spreaded.

The gas-permeation pressure loss in the cell walls 11 was gradually increasing during about 5 minutes of each particulate collecting operation, and the increased amount was as much as about 30 $mmH_2O$.

Such repeated cycles were continued for 200 hours, and there was no trouble such as the breakage of the cell walls 11 in the filter unit, the breakage and fusion of the filter plate 43 and so on. It was also found that the gas-permeation pressure loss in the cell walls 11 was gradually increasing in the first 10 hours, and after that it became substantially stable.

The outer wall 18 of the filter unit according to the present invention can be gas-permeable, however it is preferable to be gas-impermeable. The gas-impermeable outer wall can prevent the exhaust gas from discharging outside through the outer wall 18. In addition, when the outer wall 18 is gas-permeable, it is impossible to remove the particulates accumulated on the inner surface of the outer wall because the outer wall can not be refreshed by the back washing operation. When the outer wall is gas-impermeable, such problem can be avoided.

The area of the filter plate 43 or the tray 50 is 20% or below, preferably 10% or below of the filtration area of the filter unit. The reason is as follows:

In the prior art, the particulates accumulated in the vicinity of the end face of the filter unit are heated by a heater on the end face of the filter unit to start burning, the burning of the particulates is gradually spreading, and finally the particulates accumulated in the whole filter unit as well as the particulates in the vicinity of the end face of the filter unit are burned off. In order to allow the burning to spread, it is necessary to accumulate a substantial amount of the particulates per filtration area of the filter unit so as to greatly increase caloric power of burning per filtration area. As a result, the particulate collecting operation must be continued for a long time, thereby causing an average filtration pressure loss at the time of the particulate collecting operation to become remarkably great.

In accordance with the present invention, the particulates trapped in the filter unit are moved to the recollecting unit such as the filter plate or the tray, by the back washing operation. As a result, the smaller the area of the filter plate or the tray is in comparison with the filtration area of the filter unit, the more thickly the particulates deposit on the filter plate or the tray in inverse proportion to the decreased area of the filter plate or the tray, thereby allowing the particulates to be burned off easily. Accordingly, in accordance with the present invention, it is not necessary to continue the particulate collecting operation for such long time, and it is possible to refresh the filter unit by the back washing operation even if the accumulated amount of the particulates per filtration area is small, thereby decreasing the average filtration pressure loss during the particulate collecting operation greatly.

In the apparatus and method according to the present invention, the difference of the filtration pressure loss between just before the back washing operation and just after the back washing operation is 250 $mmH_2O$ or below, in particular, 100 $mmH_2O$ or below, and preferably 50 $mmH_2O$ or below, which is possible.

When the particulates peeled off by the back washing operation are returned into the intake system for a diesel engine to be burned in the engine, the particulates must be transferred through a long path to the intake valve of the engine. As a result, the back washing time must be prolonged, thereby creating great performance loss in the engine. In addition, non-combustible solid particulates are condensed in the system, which also brings about the performance loss in the engine. On the other hand, in accordance with the present invention, the particulates are recollected on the filter plate or the tray to solve such problems.

In order to carry out the back washing operation, it is possible to use a negative pressure to suck air from the side of the inlet conduit so as to generate the back washing air flow. However, it is difficult to obtain enough negative pressure in this manner. As a result, in most situations, the flow velocity of the back washing air is low, and it is difficult to obtain effective back washing. On the other hand, the provision of the nozzle in the outlet conduit for ejecting a pressurized gas of preferably 2.5–10 atmosphere gage pressure is preferable to attain the compactness of the apparatus and the effective back washing.

In the cycle comprising the particulate collecting operation and the back washing operation, it is preferable that the particulate collecting operation for 30 seconds–30 minutes, in particular 3–30 minutes, and the back washing operation for 0.01–5 seconds, in particular 0.05–1 second are alternately repeated.

The filter unit according to the present invention is not restricted to the one wherein the cells 12 and 13 having a square cross section are arranged in a check pattern. The filter units having the structures as shown in FIGS. *5a–5p* in Japanese Unexamined Patent Publication No. 124417/1981 and FIGS. 4–11 in Japanese Unexamined Patent Publication No. 129020/1981 are also applicable to the present invention.

In order to remove the particulates recollected in the recollecting unit, it is generally preferable to burn off the particulates, though a way of mechanically removing the particulates such as scraping them at appropriate intervals is also applicable. As examples of desirable burning means, there are an electric resistance type heater, and oxidation catalyst, a fluid fuel feeding type burner and so on.

In accordance with the present invention, a plurality of filter units can be utilized, and each filter unit is installed in its corresponding casing. A single filter unit can be utilized as "a plurality of filter units" by dividing it into a plurality of zones by a partition plate provided upstream and/or downstream to the filter unit so as to distribute the exhaust gas to each zone, like the third and fourth embodiments. When a plurality of filter units are utilized, the recollecting unit or the filter plate can be provided for each filter unit, or the filter units can share a single recollecting unit or a signal filter plate with one another. When a plurality of filter units are utilized, each of all the filter units is preferably subjected to the back washing operation in turn.

In accordance with the present invention, it is possible to remove the particulates accumulated on the cell walls in the filter unit from the cell walls without heating the filter unit to a high temperature, so as to refresh the filter unit. As a result, the filter unit having thin cell walls which is likely to be fused is applicable, and the flexibility of selecting the material for the filter unit is great. In addition, it is possible to maintain the filtration ability of the filter unit stable for a long time because the filter unit is not heated to a high temperature. Furthermore, the structure wherein the particulates are burned off in the recollecting unit is more compact and reliable than the structure wherein the particulates are burned off in the filter unit.

In accordance with one of the preferred embodiments of the present invention, the recollecting unit, in particular the filter plate provided in the recollecting unit is heated to a high temperature instead of heating the filter unit to the high temperature like the prior art. The structure, wherein a small size and a simple shape of filter plate is prevented from being fused, can be manufactured more easily in comparison with the structure, a large size and a complicated shape of filter unit with thin cell walls, is prevented from being fused. In addition, even if the filter plate is fused, the replacement of the fused filter plate with a new filter plate is more economical than the replacement of the fused filter unit with a ne filter unit.

In accordance with the prior art, the burning of the particulates which generally starts at one end of filter unit spreads to the center of the filter unit, and finally the particulates in the whole filter unit are burned off. In order to enable the spreading of burning, it is impossible to start burning until a certain amount of the particulates per filtration area is deposited. As a result, the refreshing cycle time exceeds one hour, and average gas-permeation pressure loss in the cell walls during the particulate collecting operation is great. The present invention is free from such restrictions, can adopt a shorter time of the refreshing cycle, and can decrease the average pressure loss in the cells during the particulate collecting operation.

What is claimed is:

1. In an apparatus for treating an exhaust gas from a diesel engine, including a filter unit in an exhaust gas passage for the diesel engine, the filter unit having a honeycomb structure wherein a plurality of cells are divided by cell walls having a filtration function and extend in the same direction as one another, predetermined cells being closed at one end, and the remaining cells being closed at the other end; the improvement comprising:

back washing gas flow generating means for generating a gas flow at appropriate intervals so as to pass through the cell walls in the direction opposite to the flow of the exhaust gas flow, and a recollecting unit for particulates, which is provided in the exhaust gas passage at a position upstream to the filter unit.

2. An apparatus according to claim 1, wherein the recollecting unit is provided near to the filter unit.

3. An apparatus according to claim 1, wherein the recollecting unit is provided below the filter unit.

4. An apparatus according to claim 1, the cross-sectional area of the exhaust gas passage at the recollecting unit is greater than the cross-sectional area of the exhaust gas passage at a position upstream to the recollecting unit.

5. An apparatus according to claim 1, wherein the back washing gas generating means comprises a nozzle for ejecting a pressurized gas, which is provided in the exhaust gas passage at a position downstream to the filter unit.

6. An apparatus according to claim 1, wherein the recollecting unit is provided with burning means for the particulates.

7. An apparatus according to claim 6, wherein the burning means is at least one as selected among an electric resistance type heater, ah oxidation catalyst and a fluid fuel feeding type combustion burner.

8. An apparatus according to claim 1, wherein the recollecting unit is provided with a filter plate.

9. An apparatus according to claim 8, wherein the filter plate is provided with burning means for the particulates.

10. An apparatus according to claim 8, wherein the back washing gas generating means comprises a nozzle for ejecting a pressurized gas, which is provided in the exhaust gas passage at a position downstream to the filter unit.

11. In a method for treating an exhaust gas from a diesel engine, comprising; using a filter unit having a honeycomb structure wherein a plurality of cells are divided by cell walls having a filtration function and extend in the same direction as one another, predetermined cells being closed at one end, and the remaining cells being closed at the other end; and passing the exhaust gas from one surface to the other surface of the cell walls; the improvement comprising;

forcing a back washing gas flow to pass through the cell walls in the direction opposite to the flow of the exhaust gas at appropriate intervals, and trapping particulates in the exhaust gas in a recollecting unit for the particulates, which is provided in an exhaust gas passage at a position upstream to the filter unit.

12. A method according to claim 11, wherein the flow velocity of the exhaust gas at the recollecting unit is smaller than that at a position upstream to the recollecting unit in the exhaust gas passage.

13. A method according to claim 11, wherein the particulates trapped in the recollecting unit are burned in the recollecting unit.

14. A method according to claim 11, wherein the recollecting unit is provided with a filter plate to trap the particulates thereon.

15. A method according to claim 14, wherein the particulates trapped on the filter plate are burned on it.

16. A method according to claim 11, wherein each time the exhaust gas is continuously passed from one surface to the other surface of the cell walls for a time not shorter than 30 seconds and not longer than 30 minutes, the back washing gas flow is forced to be passed through the cell walls in the direction opposite to the flow of the exhaust gas for a time not shorter than 0.01 seconds and not longer than 5 seconds.

17. A method according to claim 11, wherein the difference between the gas-permeation pressure loss in the cell walls just after the back washing gas flow has passed, and the gas-permeation pressure loss in the cell walls just before the back washing gas flow starts passing is 250 $mmH_2O$ or below.

18. A method for treating an exhaust gas from a diesel engine, which comprises; using a plurality of filter units having a honeycomb structure wherein a plurality of cells are divided by cell walls having a filtration function and extend in the same direction as one another, predetermined cells being closed at one end, and the remaining cells being closed at the other end; and passing the exhaust gas from one surface to the other surface of the cell walls; the improvement comprising:

forcing a back washing gas flow to pass through the cell walls in the direction opposite to the flow of the exhaust gas in at least one of the filter units at appropriate intervals;

keeping the exhaust gas to pass from one surface to the other surface of the cell walls in at least one of the remaining filter units during the time the back washing gas flow is being forced to pass through the cell walls in the direction opposite to the flow of the exhaust gas in at least one of the filter units; and trapping particulates in the exhaust gas in a recollecting unit for the particulates, which is provided in an exhaust gas passage at a position upstream to the filter unit.

19. A method according to claim 18, wherein the particulates trapped by the plural filter units are recollected in the single recollecting unit.

20. A method according to claim 18, wherein the particulates trapped by the plural filter units are recollected in the plural recollecting units which are provided so as to correspond to each filter unit.

* * * * *